US005577482A

United States Patent [19]

Nakashima et al.

[11] Patent Number: 5,577,482

[45] Date of Patent: Nov. 26, 1996

[54] FUEL SUPPLY SYSTEM FOR INTERNAL COMBUSTION ENGINES

[75] Inventors: Kazushi Nakashima; Shinichi Iwamoto, both of Obu, Japan

[73] Assignee: Nippondenso Co., Ltd., Kariya, Japan

[21] Appl. No.: 170,923

[22] Filed: Dec. 21, 1993

Related U.S. Application Data

[63] Continuation-in-part of Ser. No. 135,984, Oct. 14, 1993, Pat. No. 5,359,976.

[30] Foreign Application Priority Data

Oct. 15, 1992 [JP] Japan ..... 4-277095
Dec. 24, 1992 [JP] Japan ..... 4-342939

[51] Int. Cl.[6] ..... F02D 41/06

[52] U.S. Cl. ..... 123/491; 123/516; 123/179.16

[58] Field of Search ..... 123/179.16, 179.17, 123/491, 516, 456, 470

[56] References Cited

U.S. PATENT DOCUMENTS

| | | | |
|---|---|---|---|
| 4,198,932 | 4/1980 | Reddy | 123/491 |
| 4,294,215 | 10/1981 | Hans et al. . | |
| 4,438,748 | 3/1984 | Ikeura | 123/491 |
| 4,503,832 | 3/1985 | Pefley et al. . | |
| 4,522,177 | 6/1985 | Kawai | 123/491 |
| 4,539,961 | 9/1985 | Atkins et al. . | |
| 4,556,034 | 12/1985 | Anklam et al. . | |
| 4,601,275 | 7/1986 | Weinand . | |
| 4,683,859 | 8/1987 | Tamura et al. . | |
| 4,747,386 | 5/1988 | Onishi | 123/491 |
| 4,862,364 | 8/1989 | Matsuda | 123/491 |
| 4,875,452 | 10/1989 | Hara | 123/491 |
| 4,876,993 | 10/1989 | Slattery . | |
| 4,951,633 | 8/1990 | Achleitner | 123/491 |
| 4,955,409 | 9/1990 | Tokuda et al. . | |
| 4,966,120 | 10/1990 | Itoh et al. . | |
| 4,984,548 | 1/1991 | Hudson, Jr. . | |
| 5,044,344 | 9/1991 | Tuckey et al. . | |
| 5,074,271 | 12/1991 | Suzuki et al. . | |
| 5,078,167 | 1/1992 | Brandt et al. . | |
| 5,095,876 | 3/1992 | Yonekawa et al. . | |
| 5,179,925 | 1/1993 | Orminski | 123/491 |
| 5,233,965 | 8/1993 | Ishikawa | 123/491 |
| 5,275,145 | 1/1994 | Tuckey . | |

FOREIGN PATENT DOCUMENTS

| | | | |
|---|---|---|---|
| 512235 | 11/1992 | European Pat. Off. . | |
| 56-81230 | 7/1981 | Japan . | |
| 0048768 | 3/1983 | Japan | 123/516 |
| 60-147548 | 8/1985 | Japan . | |
| 62-137379 | 8/1987 | Japan . | |
| 25723 | 1/1990 | Japan . | |

OTHER PUBLICATIONS

Patent Abstracts of Japan vol. 9, No. 313 (M–437) 10 Dec. 1985 & JP–A–60 147 548 (Nippon Denso) 3 Aug. 1985.
Patent Abstracts of Japan vol. 11, No. 339 (M–639) 6 Nov. 1987 & JP–A–62 121 844 (Toyota Motor) 3 Jun. 1987.
Patent Abstracts of Japan vol. 13, No. 300 (M–848) 11 Jul. 1989 & JP–A–01 092 545 (Mazda Motor) 11 Apr. 1989.
Patent Abstracts of Japan vol. 8, No. 166 (M–314) 2 Aug. 1984 & JP–A–59 063 327 (Jodosha Kogai Anzen Kiki Gijutsu Kenkyu Kumiai).

*Primary Examiner*—Carl S. Miller
*Attorney, Agent, or Firm*—Cushman, Darby & Cushman

[57] ABSTRACT

In a fuel supply system for internal combustion engines, a fuel delivery pipe to which fuel injectors are mounted through respective connectors is connected to a fuel tank through a fuel piping without return piping. At least one of the connectors of the injectors is extended upwardly to open at an upper portion in the delivery pipe. In the event that air or fuel vapor is generated in the fuel supply system, it is gradually introduced into the delivery pipe and rapidly purged with fuel through the extended connectors and the injectors when the injectors inject fuel into an engine. In order to improve engine cranking operation at high temperature condition, fuel injection period is extended so that vapor or air in the fuel is purged through the injectors. The extension of fuel injection period is terminated as soon as the initial explosion in the engine is detected.

15 Claims, 17 Drawing Sheets

FUEL SUPPLY SYSTEM FOR INTERNAL COMBUSTION ENGINES

This is a continuation-in-part application of NAKASHIMA et al 08/135,984, filed on Oct. 14, 1993, now U.S. Pat. No. 5,359,976.

BACKGROUND OF THE INVENTION

The present invention relates to a fuel supply system for internal combustion engines, including a fuel delivery pipe.

In a conventional fuel supply system for internal combustion engines in which fuel injectors are supplied with fuel from a delivery pipe, air is mixed with fuel in the fuel delivery pipe for some reason or fuel vapor is generated under high temperature condition. Such air or fuel vapor is purged to a return piping through a pressure regulator when a fuel pump is in operation. For example, Japanese Laid-open utility Model No. 62-137379 discloses a fuel supply system, wherein a fuel pipe connected to the fuel delivery pipe is provided thereabove and is connected to the pressure regulator so that the air or vapor is purged to the return piping without being accumulated in the fuel delivery pipe.

It is desired to eliminate the return piping in order to simplify the fuel supply system. However, if the return piping is eliminated there is no way for air or vapor in the fuel delivery pipe to be purged and it is accumulated in the fuel delivery pipe, resulting in decrease of fuel amount to be injected.

Further, in conventional fuel supply systems such as disclosed in Japanese Laid-open Patents Nos. 56-81230, 60-147548 and 2-5723, fuel injection amount is increased until vapor or air in the fuel is purged completely.

SUMMARY OF THE INVENTION

It is therefore an object of the present invention to effectively purge air or fuel vapor accumulated in a fuel delivery pipe.

According to the present invention, a fuel injection amount is increased at the time of cranking an engine under high temperature condition and such increase is terminated when an initial explosion of fuel mixture in the engine is detected. The initial explosion may be detected by an abrupt increase in battery voltage or engine rotational speed.

Further, according to the present invention, at least one of connectors for supplying fuel to injectors connected to a fuel delivery pipe is extended to an upper portion of a delivery pipe and sucking ports of the connectors are opened at the upper portion of the inside of the fuel delivery pipe.

BRIEF DESCRIPTION OF THE DRAWINGS

In the accompanying drawings

DETAILED DESCRIPTION OF THE PREFERRED EMBODIMENTS

Figure 6:
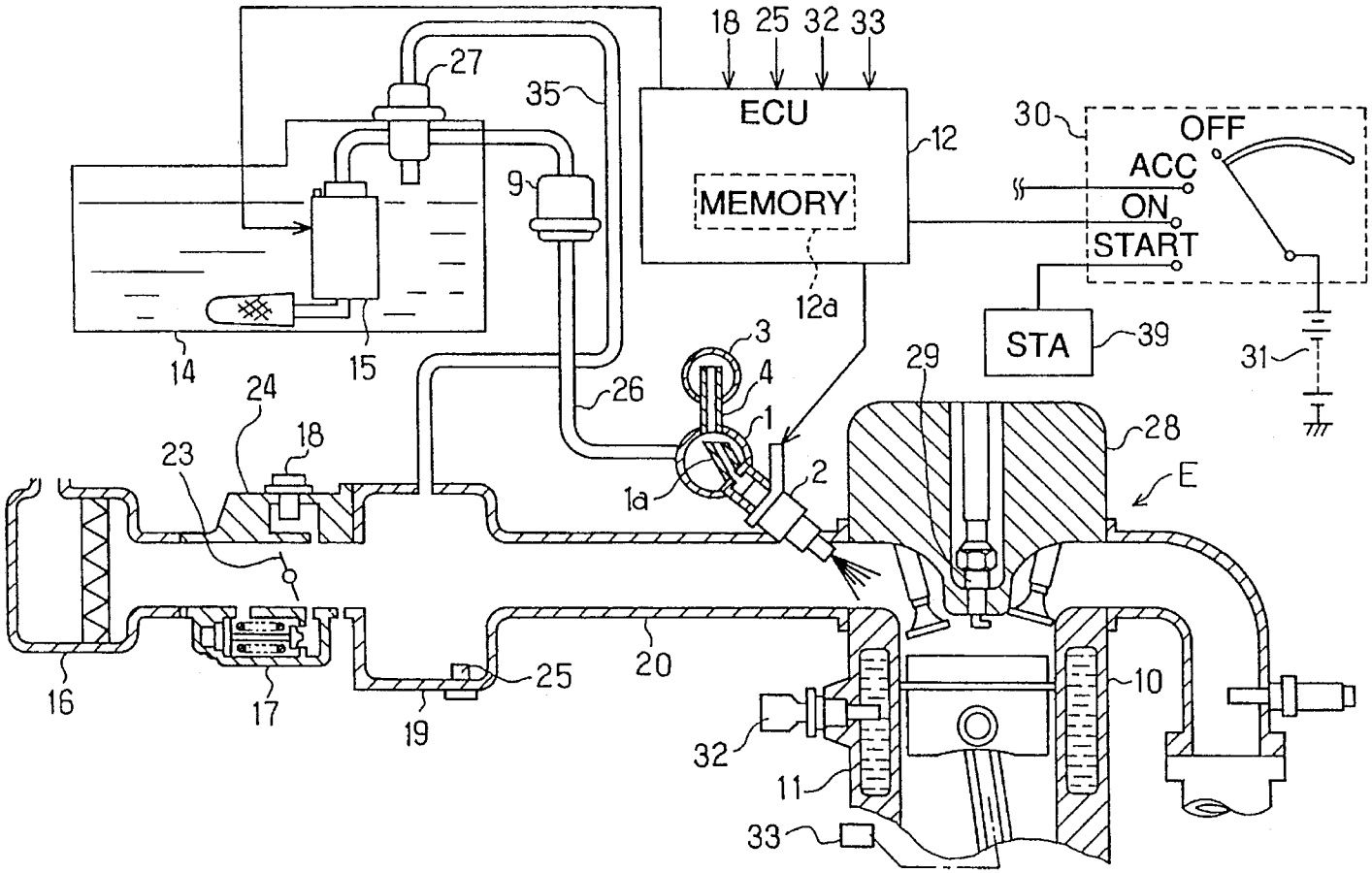
FIG. 6 is a schematic view of a fuel injection control system to which the above embodiments are applied.

First, reference is made to FIG. 6 showing a fuel injection control system in which a fuel supply system of the present invention is applied. In a multi-cylinder engine E, an intake pipe 20 is attached to an engine body 10. At an upstream of the intake pipe 20, a throttle body 24, in which a throttle valve 23 operated by an acceleration pedal (not shown in FIG. 6) is installed, is connected thereto. At a downstream of the throttle valve 23, there is installed a surge tank 19 having an intake air temperature sensor 25 therein. An idle speed control valve 17 for controlling by-pass air and intake air pressure sensor 18 are attached to the throttle body 24. At the end of the downstream of the intake pipe 20, an injector 2 for injecting fuel to each cylinder of the engine E is mounted. An air cleaner 16 is installed at an upstream of the throttle body 24. A spark plug 29 is mounted on a cylinder head 28 of each cylinder of the engine E. A sensor 32 for detecting temperature of cooling water circulating in the engine body 10 is installed in a cylinder block 11. A rotational angular sensor 33 is provided for generating a signal at each predetermined rotational angle of a crankshaft of the engine E (not shown in the drawing).

A starter motor 39 for cranking the engine E is connected to a battery 31 through a key switch 30. The starter motor 39 is driven by the battery 31 through operation of the key switch 30. The key switch having four positions, "OFF", "ACC", "ON" and "START" is operated by a key (not shown in the Figure). As the key switch 30 is turned from the "OFF" position to the "ACC" position, electric power is supplied to head lights and a radio, etc. As the key switch 30 is turned to "ON", electric power is supplied to an electronic control unit which will be explained later from the battery 31. At the "START" position, the electric power is supplied to the starter motor 39.

An electronic control unit (hereinafter referred to as ECU) 12 is operated by electric power supplied from the battery 31. Information such as intake air temperature TA, intake pressure Pm, water temperature Tw and engine speed Ne are fed to the ECU 12 from the intake air temperature sensor 25, the intake air pressure sensor 18, the water temperature sensor 32 and the rotational angular sensor 33, respectively. The ECU 12 generates output signals for driving the injectors 2 and a fuel pump 15 according to the aforementioned input information. In the ECU 12, a memory 12*a* is provided for temporarily storing signals from the various sensors and results of calculation.

In the fuel supply system, the fuel pump 15 for pumping fuel is installed in a fuel tank 14. A fuel piping 26 connects the fuel pump 15 and a fuel delivery pipe 1 through a fuel pressure regulator 27 and a fuel filter 9. The fuel delivery pipe 1 is connected to a fuel pipe 3 by a connector 4 and connected to each injector through a connector 4. The delivery pipe 1 temporarily stores fuel therein and distributes fuel to the injectors 2. Intake negative pressure is introduced to the fuel pressure regulator 27 through a negative pressure piping 35. Thus the fuel pressure in the fuel delivery pipe 1 is maintained at a predetermined value by the fuel pressure regulator 27. The pressure regulator 27 may be installed within the fuel tank 14 and, instead of the intake negative pressure, atmospheric pressure or fuel tank inner pressure may be introduced to the pressure regulator 27. It is to be noted that the fuel supply system in FIG. 6 has no fuel return piping and the fuel pressure regulator 27 is provided between the fuel pump 15 and he fuel delivery pipe 1.

The above-described fuel supply system will be explained in more detail with reference to preferred embodiments shown in FIGS. 1 through 5.

Figure 1:
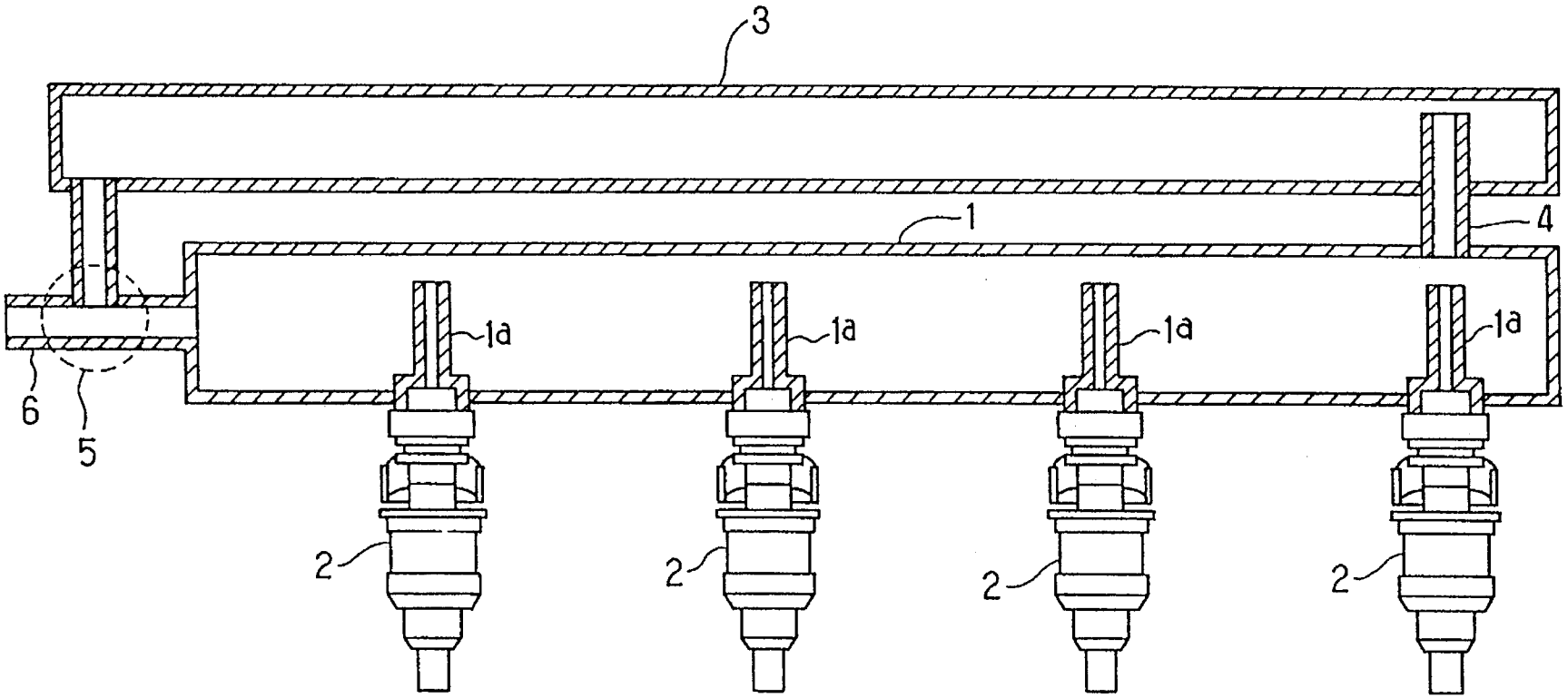
FIG. 1 is a front cross-sectional view of a first embodiment of the present invention.
Figure 2:
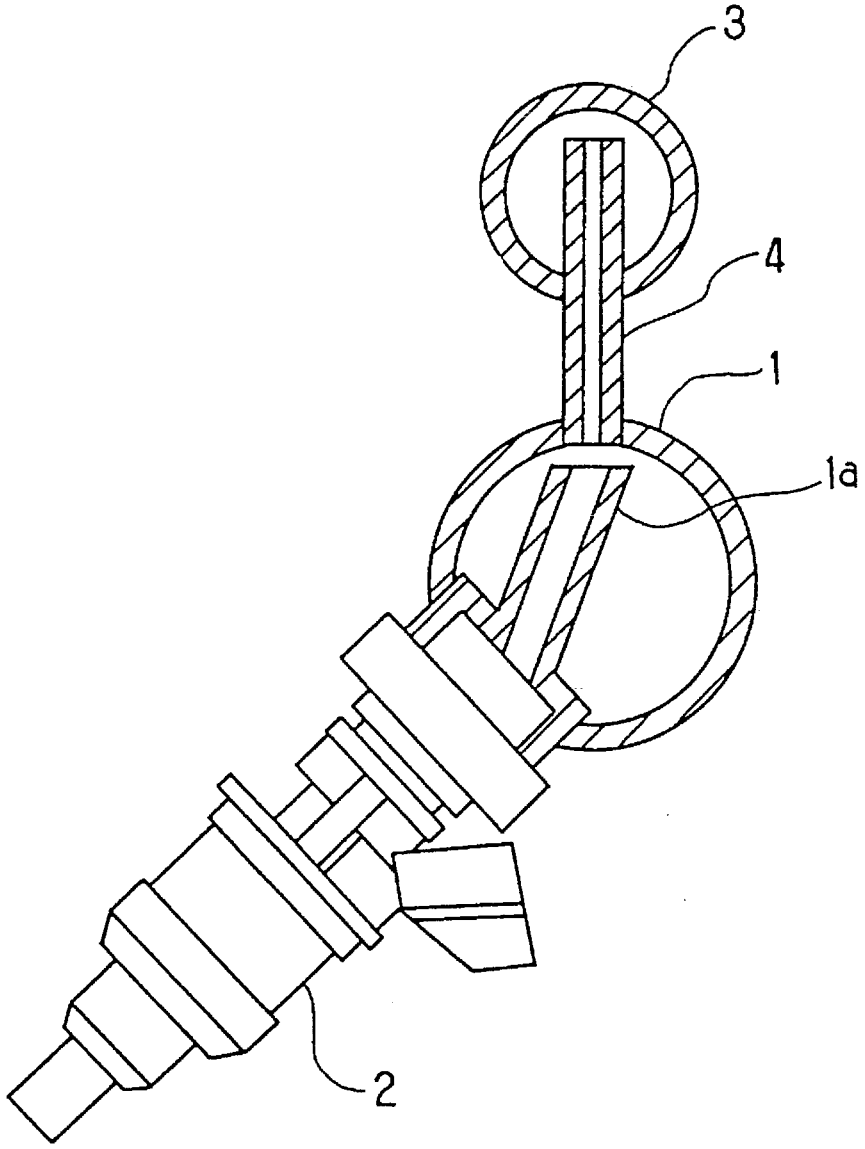
FIG. 2 is a side cross-sectional view of a first embodiment of the present invention shown in FIG. 1.

In a first embodiment shown in FIGS. 1 and 2, all the connectors 1*a* of the fuel injectors 2 are extended into an upper portion in the fuel delivery pipe 1, and the fuel sucking ports of the connectors 1*a* which supply fuel to the injectors 2 are opened at the upper portion of the fuel delivery pipe 1. The fuel pipe 3 is branched off at the upstream of the fuel delivery pipe 1 through a branch intersection 5 connected to a fuel piping 6 which is designated by a reference numeral 26 in FIG. 6. The fuel pipe 3 is mounted above the fuel delivery pipe 1 in parallel therewith. The closed end portion of the fuel pipe 3 and the closed end portion of the fuel delivery pipe 1 are connected with each other by means of a pipe-shaped connecting orifice 4. The connecting orifice 4 is extended into the fuel pipe 3 and opened at an upper portion in the back-end of the fuel pipe 3.

The first embodiment operates in the following manner.

(1) Air mixed in the fuel piping 6 is separated by floating force at the branch intersection 5 and delivered to the fuel pipe 3 to be stored therein. When the injectors 2 are operated to inject fuel intermittently into the engine, there occurs pressure fluctuation between the fuel in the delivery pipe 1 and in the fuel pipe 3. Because of this, the air is broken into small size, sucked into the fuel delivery pipe 1 through the connecting orifice 4 and then injected with fuel through the injectors 2. That is, the air in the fuel is purged by operation of the injectors 2. Decrease of the injected fuel amount is negligible, because the air purged in one injection is very small and fuel pressure during operation of the injectors 2 is actually increased due to expansion of the air stored in the fuel pipe 3. Thus, engine driveability is kept in the same level as normal operation when there is no air in the fuel pipe 3.

(2) Fuel vapor generated in the fuel delivery pipe 1 at high temperature is transferred to the fuel delivery pipe 3 through the branch intersection 5, because the vapor is lighter than fuel. The vapor is purged in the same way as the air mentioned above.

(3) In a particular case such as engine mounting at a factory, a large amount of air which can not be stored in the fuel pipe 3 may be mixed. In this case, the large amount of the air can be purged through the injectors 2 during engine cranking period, because all the connectors 1*a* are opened at the upper portion in the fuel delivery pipe 1 for sucking the air into the injectors 2 with ease.

Figure 3:
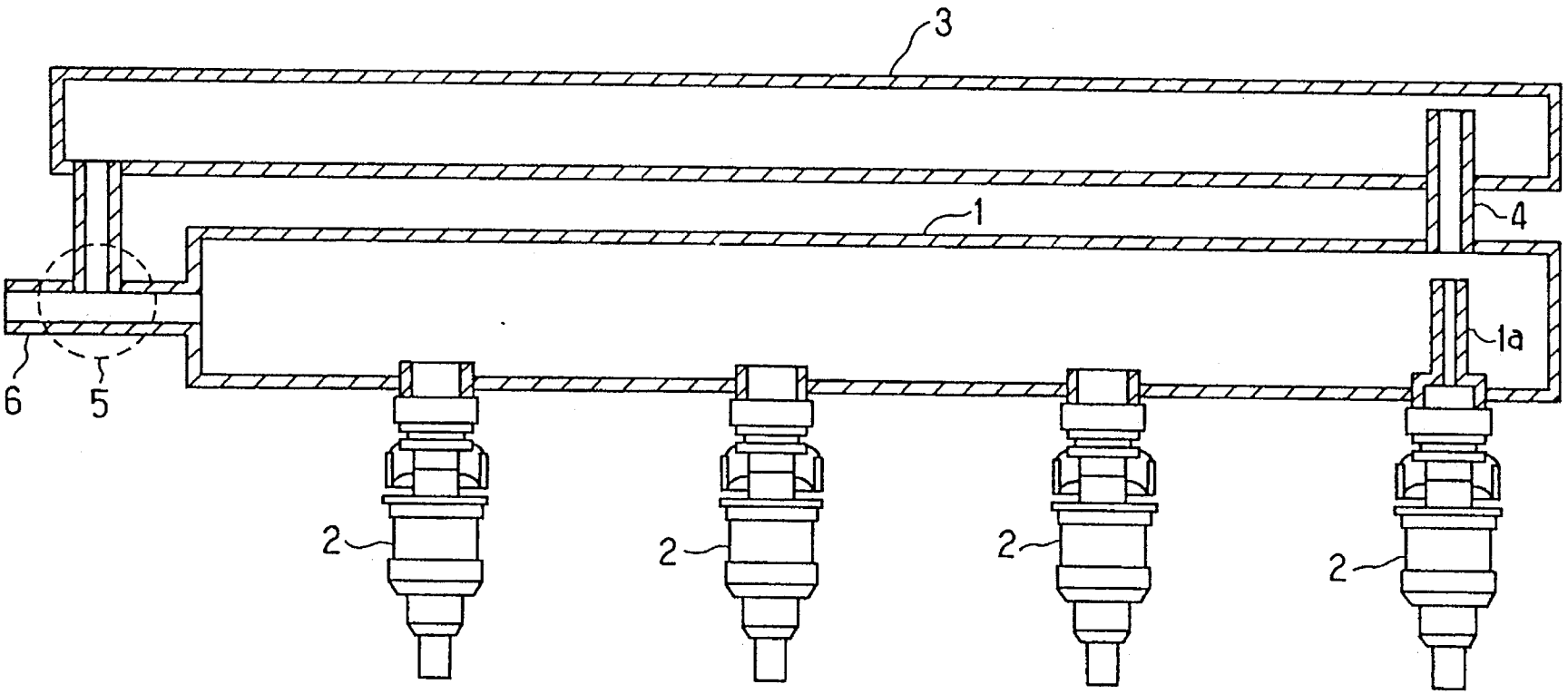
FIG. 3 is a front cross-sectional view of a second embodiment of the present invention.

In a second embodiment shown in FIG. 3, only one of the connectors 1*a*, i.e. the right-most connector in the Figure, which connects the fuel delivery pipe 1 with the injectors 2 is extended into the upper portion in the fuel delivery pipe 1 at the closed end portion thereof, and the sucking port of the extended connector 1*a* is opened at the upper portion in the fuel delivery pipe I while the sucking ports of the other connectors 1*a* are opened at the lower portion in the fuel delivery pipe 1.

The second embodiment operates in the same manner as the above-described first embodiment with regard to the purging of air (1) and fuel vapor (2). In a particular case such as engine mounting at a factory, a large amount of air which can not be stored in the fuel pipe 3 may be mixed. In this case the large amount of the air will be purged in the following process.

(3) When the amount of the air exceeds the amount that the fuel pipe 3 can store therein, the excessive air will be purged gradually through the right-most connector 1*a*. In this case, the engine may be operated only by the cylinders with injectors 2 which are not connected to the extended connector 1*a*. During this operation, the engine output may be degraded a little, but this does not cause any problem because this operation occurs only in the particular case as above mentioned.

Figure 4:
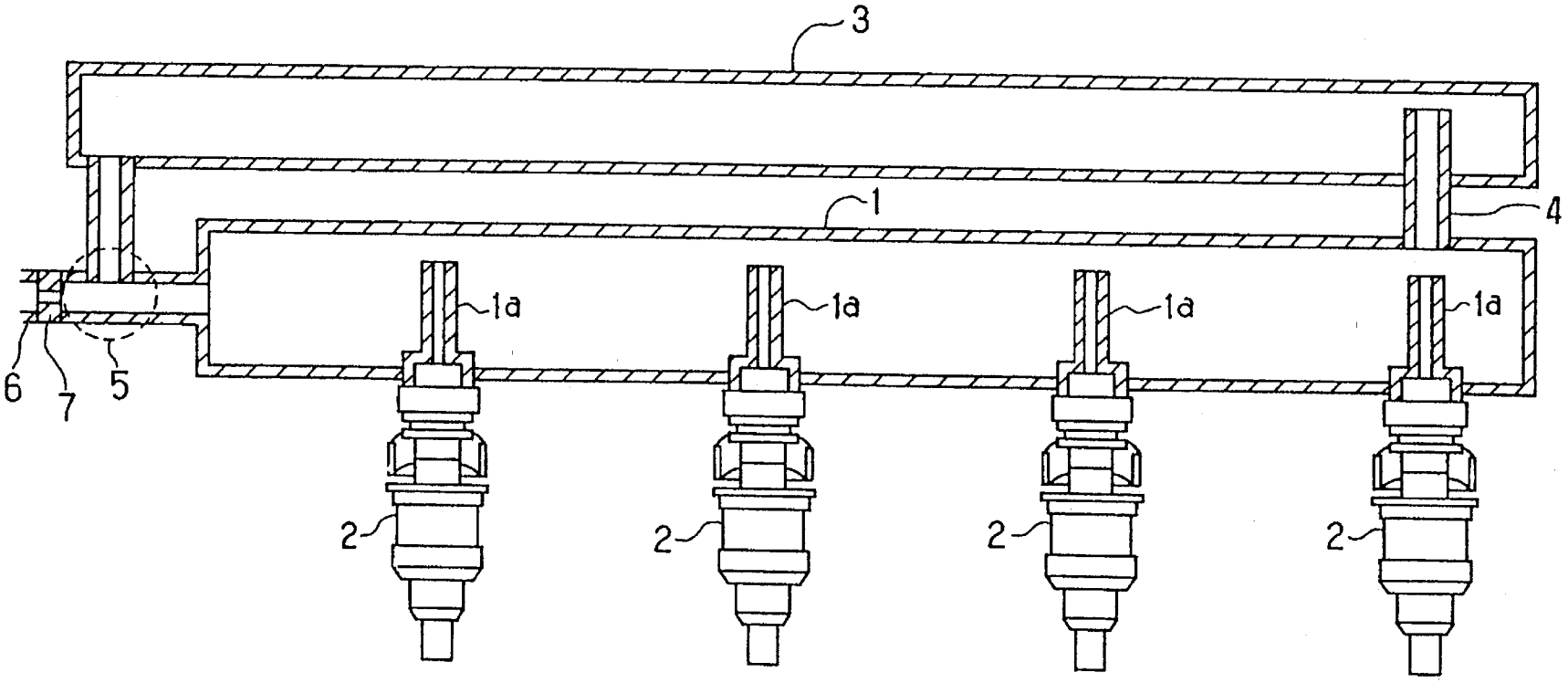
FIG. 4 is a front cross-sectional view of a third embodiment of the present invention.

In a third embodiment shown in FIG. 4, an orifice 7 is provided in the fuel piping 6 at an upstream of the branch intersection 5. All the connectors 1*a* of the injectors 2 are extended as in the above-described first embodiment.

According to this third embodiment, the air is better separated from fuel at the branch intersection 5 because the air mixed with fuel flowing through the fuel piping 6 is broken into smaller size by means of the orifice 7.

Figure 5:
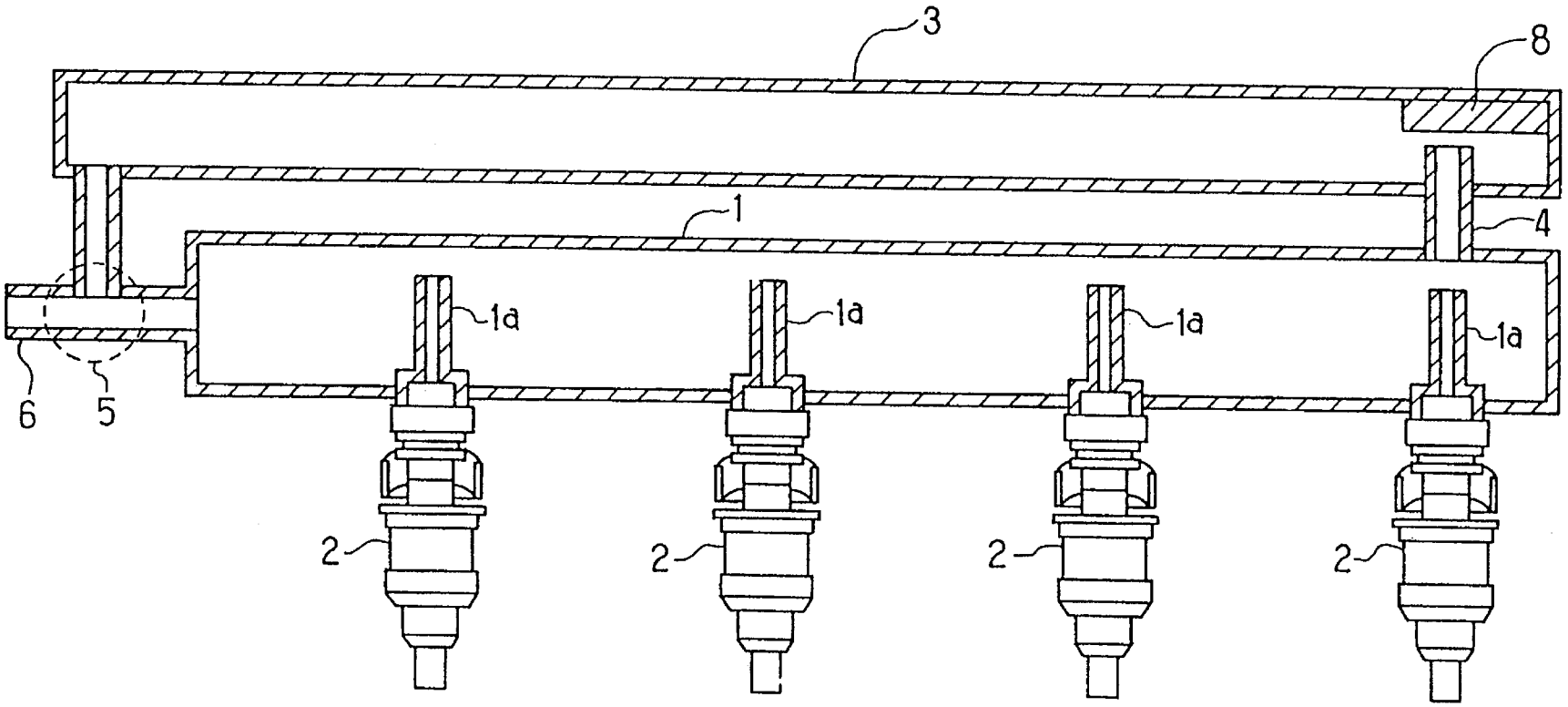
FIG. 5 is a front cross-sectional view of a fourth embodiment of the present invention.

In a fourth embodiment shown in FIG. 5, a spacer 8 is added to the first embodiment of FIGS. 1 and 2. The spacer 8 is provided in the fuel pipe 3, so that the cross sectional area of the fuel pipe 3 at the neighborhood above the connecting orifice 4 is made smaller than that of other portion, with a small gap left between the spacer 8 and the extended upper end of the connecting orifice 4.

According to this fourth embodiment, when the amount of air or fuel vapor contained in the fuel pipe 3 becomes less than the predetermined amount, the sucking port of the connecting orifice 4 does not come into contact with the air or fuel vapor. Thus a certain amount of the air or vapor remains in the fuel pipe 3. Because of expansion of the remaining air or vapor in the fuel pipe 3, pressure fluctuation in the fuel piping 6, the fuel delivery pipe 1 and the fuel pipe 3 is controlled, resulting in smaller pressure fluctuation in the whole fuel supply system.

Figure 8:
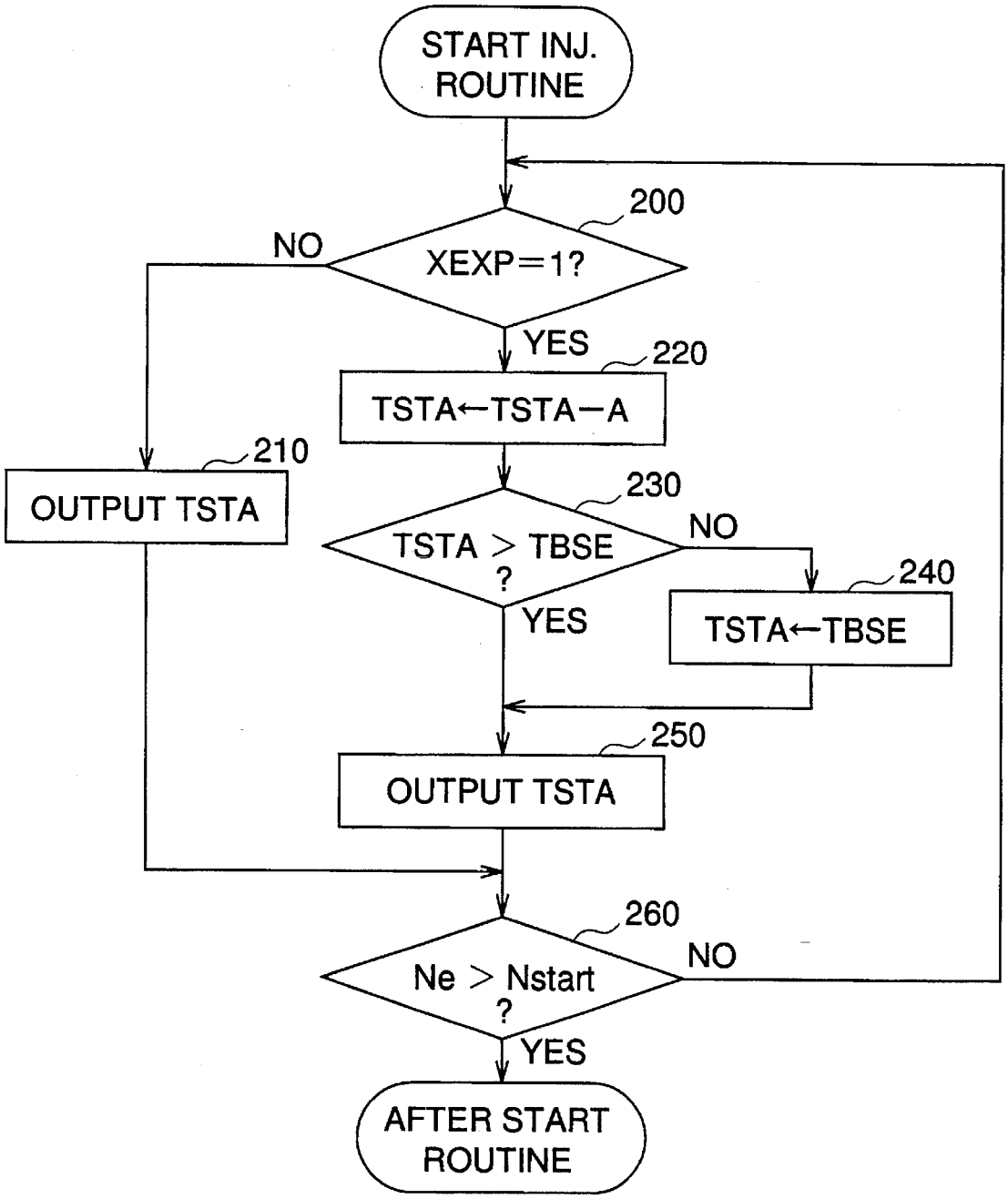
FIG. 8 is a flow chart showing a start injection routine performed by the ECU shown in FIG. 6.
Figure 9:
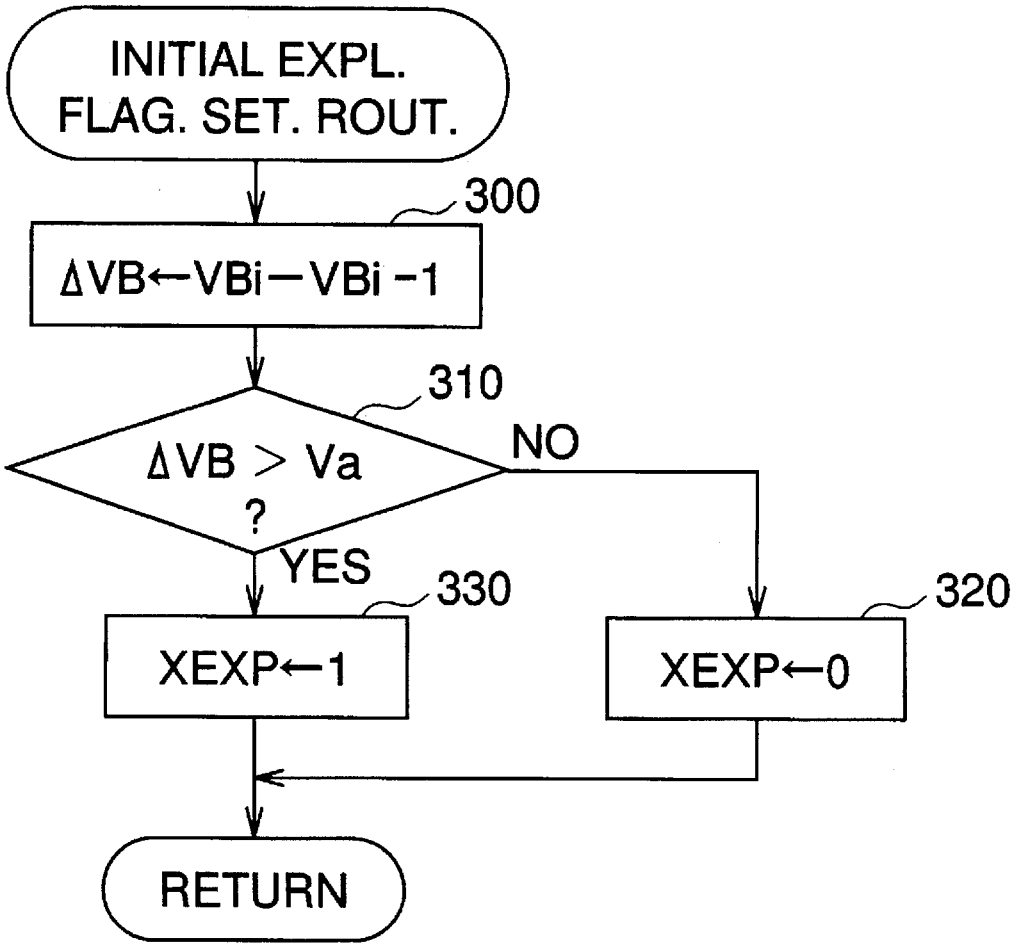
FIG. 9 is a flow chart showing an initial explosion flag setting routine performed by the ECU shown in FIG. 6.

Hereinafter, overall operation of the fuel injection control system shown in FIG. 6, particularly operation of the ECU 12, will be explained with reference to FIGS. 7 through 14. It is to be understood that an initial routine shown in FIG. 7 starts as the key switch 30 is turned to the "ON" position from the "OFF" position or "ACC" at a timing t1 shown in FIG. 10. When the key switch 30 is turned to the "START"

position from the "ON" position at a timing t2, a start injection routine shown in FIG.8 is put into operation. An initial explosion flag setting routine shown in FIG. 9 is repeated at every predetermined crank angle, interrupting the start injection routine of FIG. 8.

Figure 10:
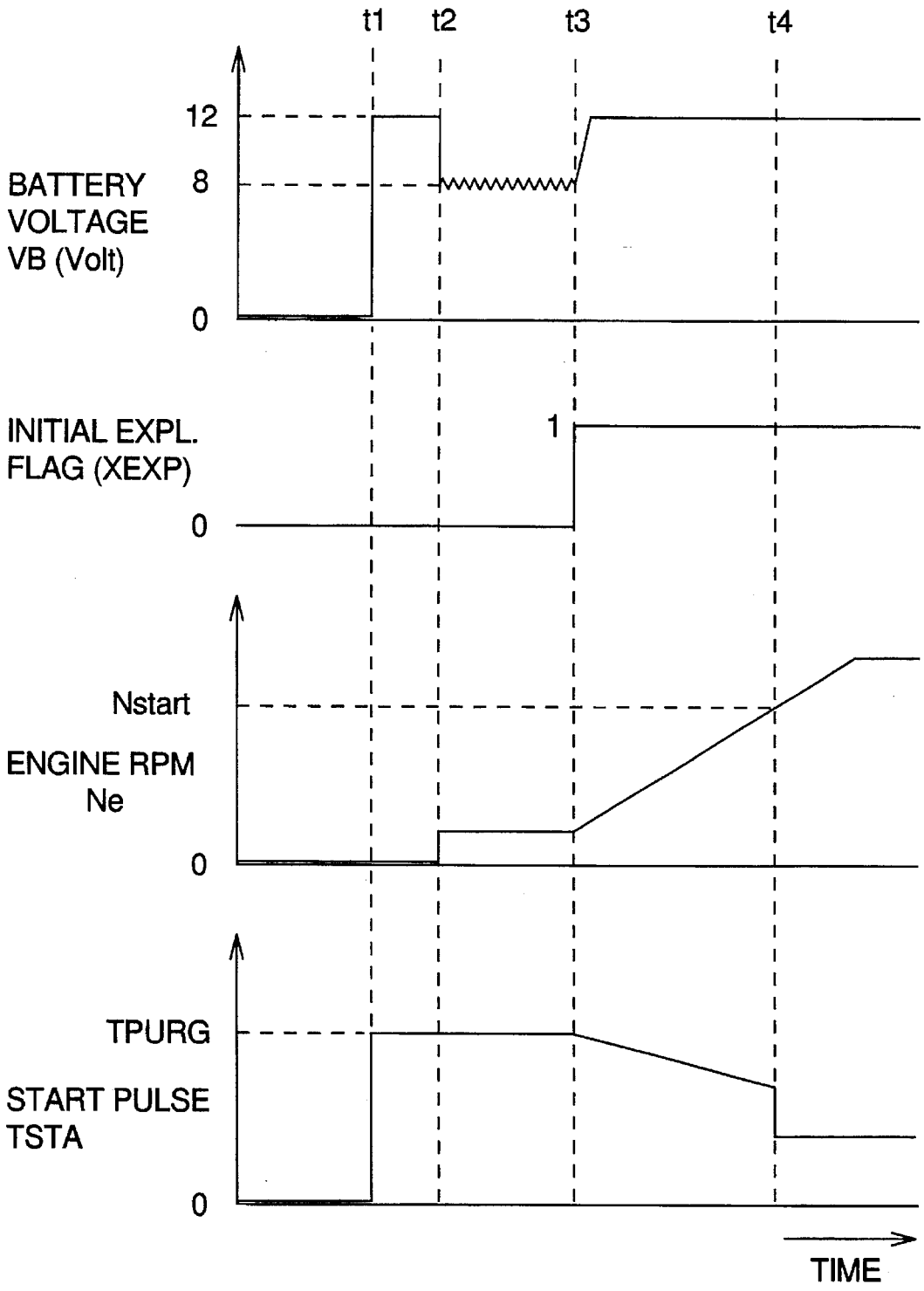
FIG. 10 is a time chart for explaining the flow charts in FIGS. 7, 8 and 9.
Figure 11:
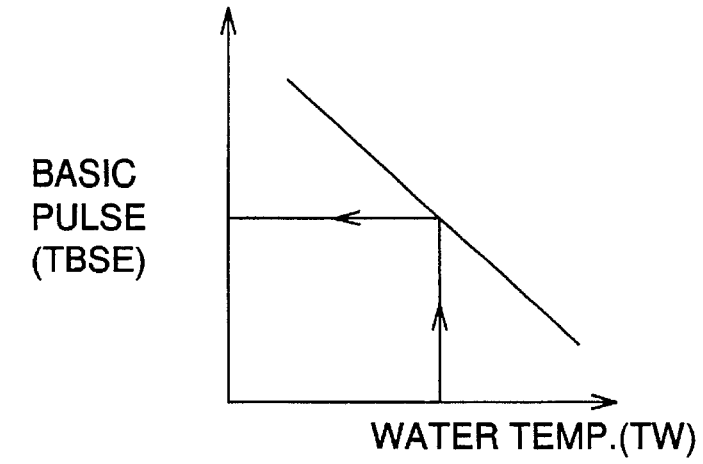
FIG. 11 is a graph showing a relation between water temperature and a basic pulse.
Figure 12:
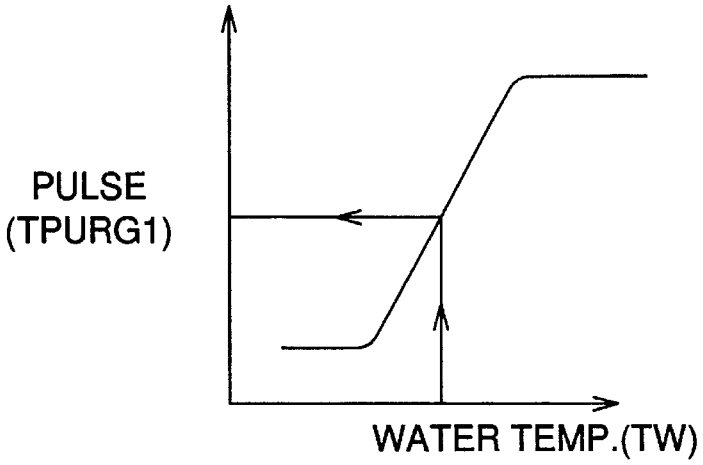
FIG. 12 is a graph showing a relation between water temperature when engine is operated under high temperature condition and a pulse.
Figure 13:
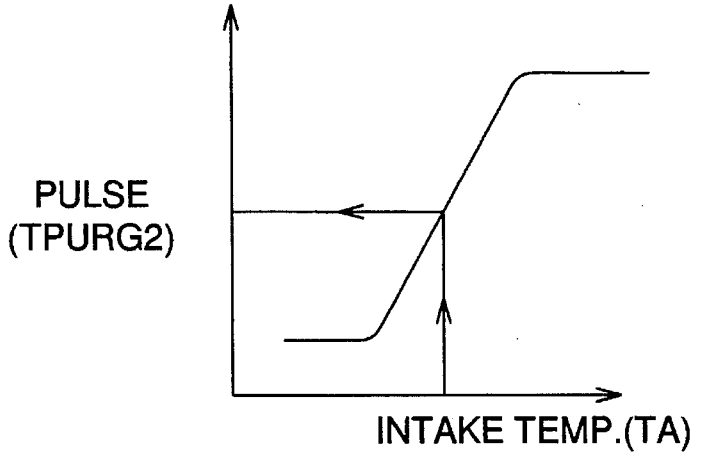
FIG. 13 is a graph showing a relation between intake air temperature when engine is operated under high temperature condition and a pulse.

At the timing t1 in FIG. 10, the key switch 30 is turned to the "ON" position, and electric power is supplied to ECU 12 from the battery 31. At this time, as shown in FIG. 10, a rated battery voltage (12 V in this embodiment) is supplied to the ECU 12 which turns on the initial routine shown in FIG. 7.

Figure 7:
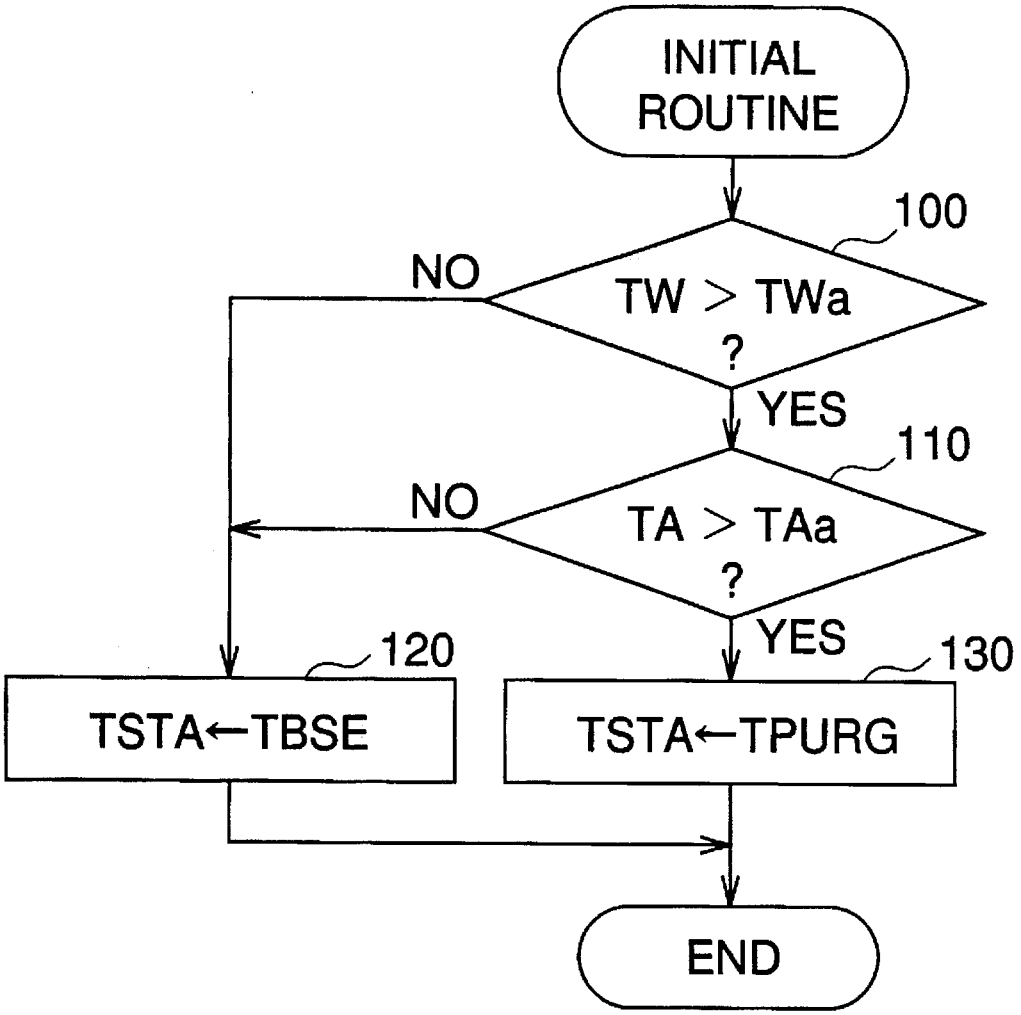
FIG. 7 is a flow chart showing an initial routine performed by an ECU shown in FIG. 6.

As the initial routine starts, ECU 12 judges whether the engine E is under high temperature condition or not in steps 100 and 110 shown in FIG. 7. That is, the ECU 12 judges whether the water temperature TW detected by the water temperature sensor 32 is higher than a predetermined water temperature TWa in the step 100. It also judges whether the intake air temperature TA detected by the intake air temperature sensor 25 is higher than a predetermined intake air temperature TAa in the step 110.

If either one of the steps 100 or 110 in FIG. 7 is not affirmative, the ECU 12 judges that the engine E is not under high temperature condition and then moves to a next step 120. In the step 120, the ECU 12 calculates a starting pulse TSTA not modified by high temperature condition, i.e. a basic pulse TBSE and the basic pulse TBSE is memorized in the memory 12*a* as TSTA. The basic pulse TBSE is the value calculated according to water temperature T at a given time, using, for example, the map shown in FIG. 11 in which the basic pulse TBSE is set lower as the water temperature T becomes higher. The ECU 12 finishes the initial routine when the TSTA has been calculated.

When both of the steps 100 and 110 in FIG. 7 are affirmative (TW>TWa, TA>TAa), the ECU 12 judges that the engine E is under high temperature condition and moves to a next step 130. In the step 130 the ECU calculates the starting pulse TSTA modified by the high temperature condition, i.e. a high temperature pulse TPURG and memorizes the TPURG in the memory 12*a* as the TSTA. The high temperature pulse TPURG is calculated according to the water temperature TW and the intake air temperature TA at that time, using, for example, maps shown in FIGS. 12 and 13. That is, TPURG1 and TPURG2 are determined according to the water temperature T and the intake air temperature TA, respectively, and the added value thereof makes TPURG (TPURG=TPURG1+TPURG2). Therefore, the higher the water and intake air temperature become, the longer the high temperature pulse TPURG is. After the starting pulse has been calculated at the step 130, the ECU 12 finishes the initial routine. Thus, when the engine is restarted under the high temperature condition, the high temperature pulse TPURG is set as TSTA at the timing t1.

At the timing t2 shown in FIG. 10, the key switch 30 is turned to the "START" position and the starter motor 39 begins to run. While the starter motor 39 is cranking the engine E, the rotational speed Ne of the engine E is kept at the same speed as that of the starter motor 39 (100 through 200 rpm). At the same time the battery voltage VB drops due to operation of the starter motor 39 (about 8 Volts). At the timing t2 the start injection routine shown in FIG. 8 is also started. The ECU 12 judges whether an initial explosion flag XEXP is 1 or 0 at a step 200 shown in FIG. 8. The initial explosion flag XEXP is determined by the initial explosion flag setting routine shown in FIG. 9 which will be explained in the following.

In FIG. 9, the ECU 12 calculates battery voltage variation ΔVB from the battery voltage VBi-1 at the time of previous calculation and VBi at this time (ΔVB=VBi−VBi−1). Then the ECU 12 judges whether the voltage variation ΔVB is larger than a predetermined value Va or not at a step 310. During the period from t2 to t3 shown in FIG. 10, the battery voltage VB is kept approximately constant (about 8 Volts) because of cranking the engine by the starter motor 39. The battery voltage variation ΔVB, therefore, is smaller than the predetermined value Va, causing the ECU 12 move from the step 310 to the step 320 where the initial explosion flag XEXP is set to "0".

At a timing t3 shown in FIG. 10, the engine E generates torque due to the initial explosion, and the battery voltage VB rises up rapidly because the load of the starter motor 39 becomes lighter rapidly. This makes the battery voltage variation ΔVB larger than the predetermined value Va. As the ECU 12 detects this, it judges that the initial explosion occurred and moves to a next step 330 from the step 310, turning the initial explosion flag to "0". At this timing t3, the engine speed Ne also rises up according to the initial explosion.

Thus, the initial explosion flag XEXP is kept as "0" until the timing 13 shown in FIG. 10 and thereafter it is set as "1". Therefore, the ECU 12 always goes to a step 210 from the step 200 shown in FIG. 8 during the period from t2 and t3. The ECU 12 outputs at the step 210 the same TSTA pulse (the basic pulse TBSE or the high temperature pulse TPURG) as was memorized in the memory 12*a* in the initial routine shown in FIG. 7 to the injectors 2. Because the high temperature pulse TPURG is set substantially larger than the basic pulse TBSE, the fuel vapor generated in the injectors 2 and the fuel delivery pipe 1 when the engine is operated under high temperature condition can be purged through the injectors 2 driven by the high temperature pulse TPURG.

After the ECU 12 outputs the starting pulse TSTA, it moves from the step 210 to 260 shown in FIG. 8. At the step 260, the ECU 12 determines whether the present engine speed Ne is higher than the start judgment speed Nstart. The start judgment speed Nstart is a predetermined value for judging engine start. The fact that the engine speed Ne reached the engine start judgment speed Nstart indicates that the engine E reached the normal operation. During the cranking period between t2 and t3, the step 260 becomes negative so that the ECU operation returns to the step 200. Therefore, the ECU 12 repeats the steps 200, 210 and 260 until the timing t3 comes, i.e. until the initial explosion takes place.

As the initial explosion flag XEXP turns to "1" at the timing t3 shown in FIG. 10, the ECU 12 judges that the fuel vapor in the injectors 2 and the fuel delivery pipe 1 has been purged and moves from the step 200 to the step 220 shown in FIG. 8. At the step 220, the ECU 12 subtracts a predetermined value A from the starting pulse TSTA which has been memorized in the memory 12*a* in the initial routine shown in FIG. 7. Then, the ECU 12 moves from the step 220 to the step 230 where it judges whether or not the starting pulse TSTA calculated at the step 220 is larger than the basic pulse TBSE. If the starting pulse TSTA is larger than the basic pulse, the ECU 12 moves to the step 250 where it outputs the starting pulse TSTA to the injectors 2. If the starting pulse TSTA is smaller than the basic pulse TBSE at the step 230, the ECU 12 moves to the step 240 where it uses the basic pulse TBSE as the starting pulse TSTA. In other words, the ECU 12, through the operation at the steps 230 and 240, forbids that the starting pulse TSTA becomes smaller than the basic pulse TBSE.

At a step 260, the ECU 12 determines whether the present engine speed Ne is larger than the start judgment speed Nstart. During the period between the timing t3 and t4 shown in FIG. 10, the step 260 is not affirmative (Ne<Nstart), making the ECU 12 return to the step 200. The ECU 12 repeats the steps 200, 220, 230, 250 and 260 until the timing t4 comes, i.e. until the engine speed Ne becomes higher than the start judgment speed Nstart. During this operation the starting pulse TSTA is decreased gradually by the step 220.

At a timing t4 shown in FIG. 10, the step 260 becomes affirmative (Ne>Nstart). At this time the ECU 12 judges that the engine rotation is stabilized and terminates the operation of the start injection routine. Hereafter, the ECU 12 moves to an after-start routine (which is not shogun in the drawing) and continues a normal injection control.

According to this invention, the conventional return piping can be eliminated in the fuel supply system. The fuel vapor generated by engine operation at high temperature can be effectively purged through the injectors 2 without having the return piping as described above. As opposed to the conventional fuel injection control system which uniformly sets the timing for increasing injection fuel amount, the fuel supply system according to this invention avoids excessive increase of fuel amount to be injected and attains proper control of the fuel supply. Thus, problems such that air-fuel ratio becomes over-rich or spark plugs get wet by fuel can be solved. Moreover, the engine E can be easily restarted under high temperature condition.

Figure 14:
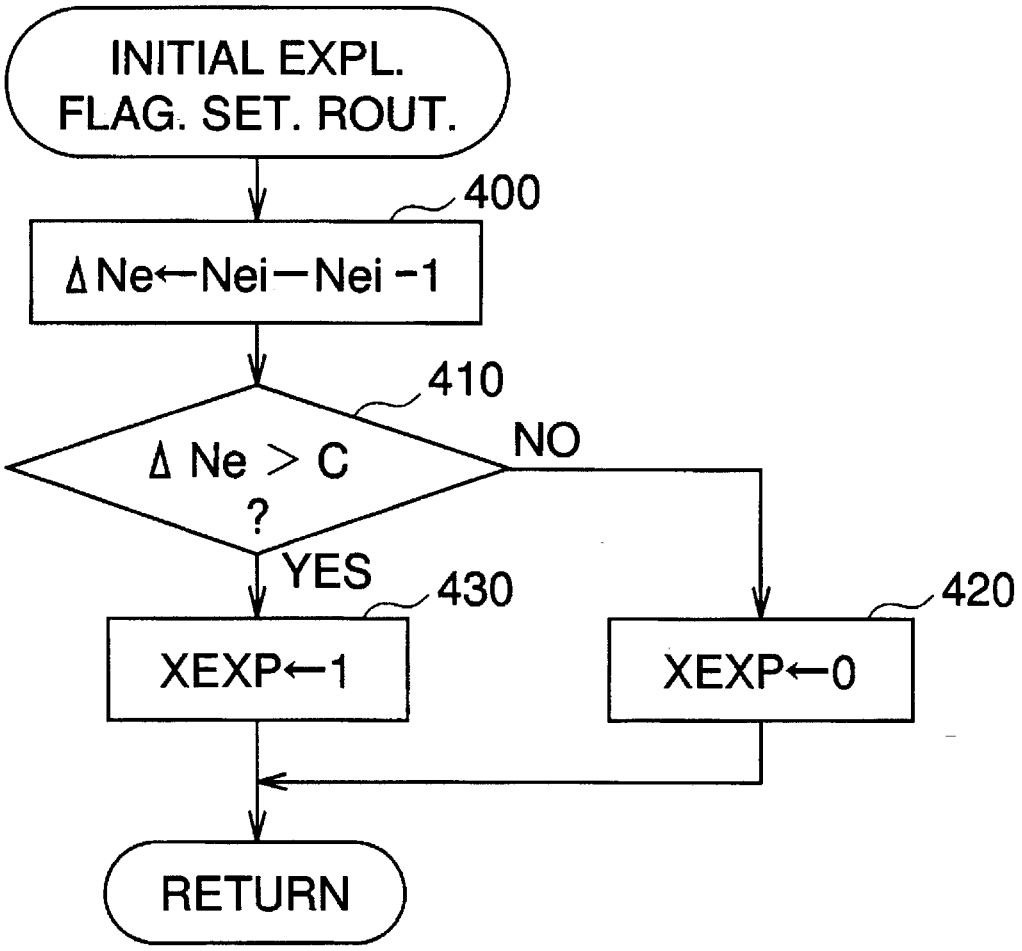
FIG. 14 is a flow chart showing a modification of the initial explosion flag setting routine.

It is to be noted that the initial explosion flag setting routine shown in FIG. 9 can be substituted by a routine shown in FIG. 14. In FIG. 14, the ECU 12 calculates at a step 400 the engine speed variation ΔNe from the engine speed Nei-1 at the previous operation and the engine speed Nei at this time (ΔNe=Nei–Nei–1). During the period between t2 and t3, wherein the engine is being cranked, the engine speed variation ΔNe is smaller than the predetermined value C. Accordingly, the ECU 12 performs consecutively the steps 400, 410 and 420, and at the step 420 it sets the initial explosion flag as "0".

At the timing t3 shown in FIG. 10, the engine speed Ne begins to increase and the variation of the engine speed ΔNe exceeds the predetermined value C. Then, the steps of the ECU 12 move from 400 to 410 and from 410 to 430, and at the step 430 the initial explosion flag is set to "1". Thus, in the routine shown in FIG. 14, the engine speed variation ΔNe is used as a parameter to determine the initial explosion. The present invention is not limited to the embodiments above-mentioned, but some other variations will be possible. For example, the high temperature pulse TPURG can be switched to the basic pulse TBASE immediately after detection of the initial explosion, i.e. at the timing t3 in FIG. 10, as opposed to the process wherein the high temperature pulse TPURG is gradually decreased to the level of the basic pulse TBSE as explained above. It is also possible to increase gradually the high temperature pulse after start, i.e. at the timing t1, as opposed to the process wherein the high temperature pulse TPURG is used immediately after detection of start at the timing t1.

Figure 15:
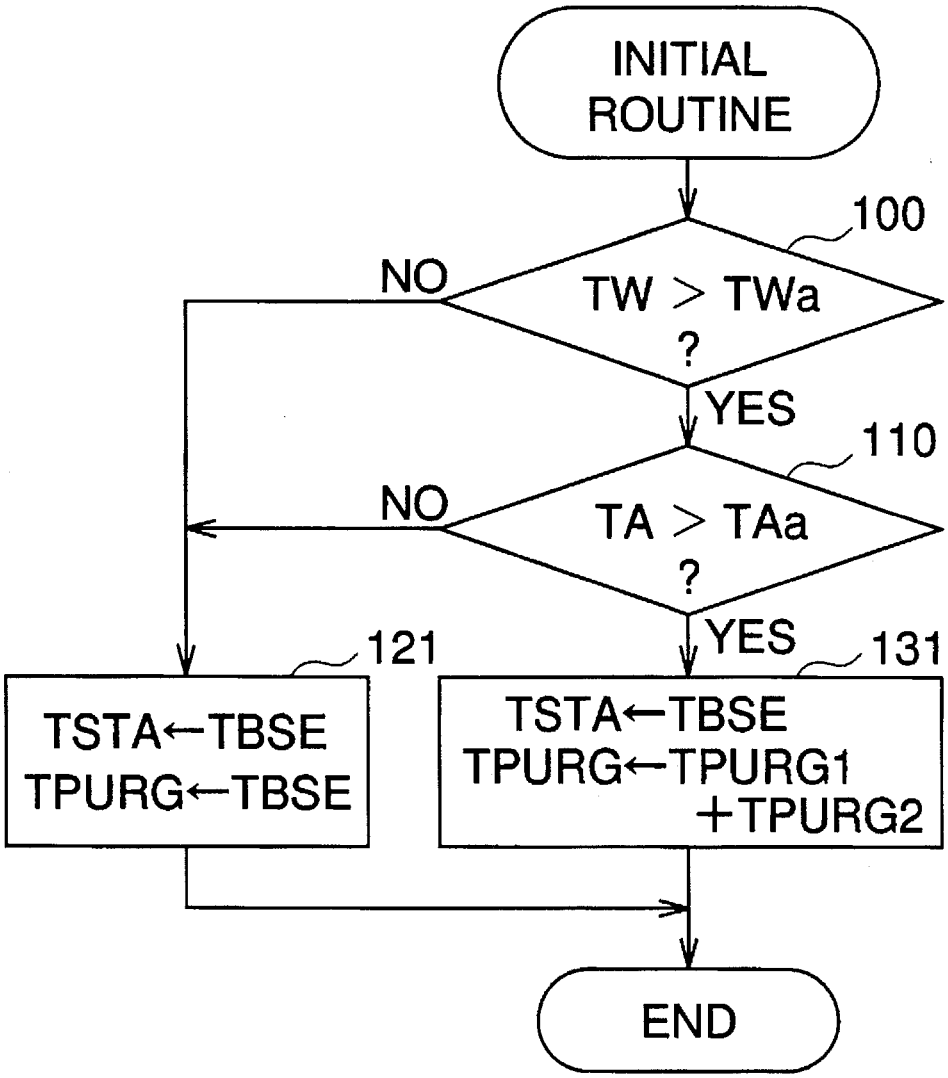
FIG. 15 is a flow chart showing a modification of the initial routine of FIG. 7.
Figure 16:
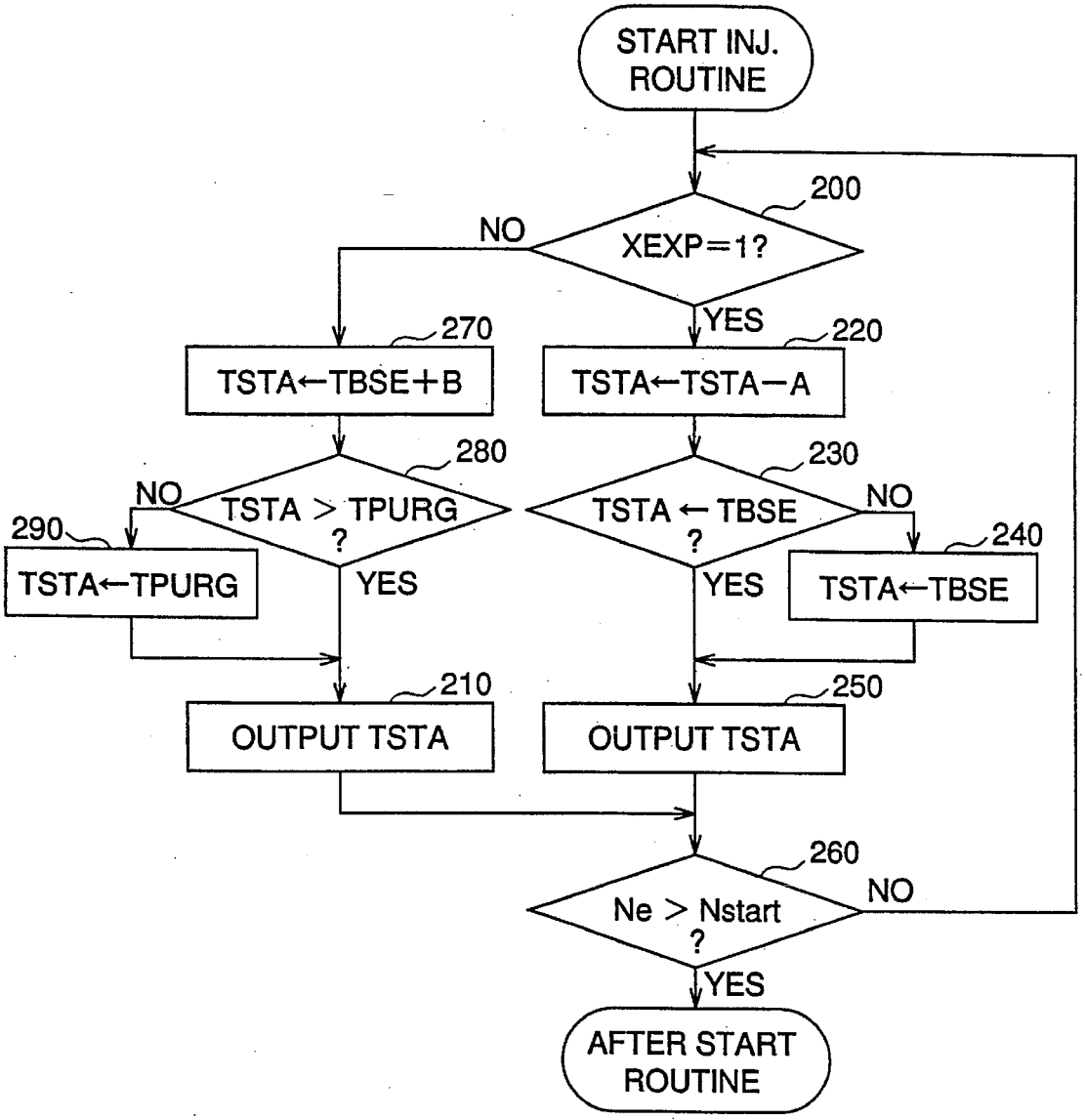
FIG. 16 is a flow chart showing a modification of the start injection routine of FIG. 8.
Figure 17:
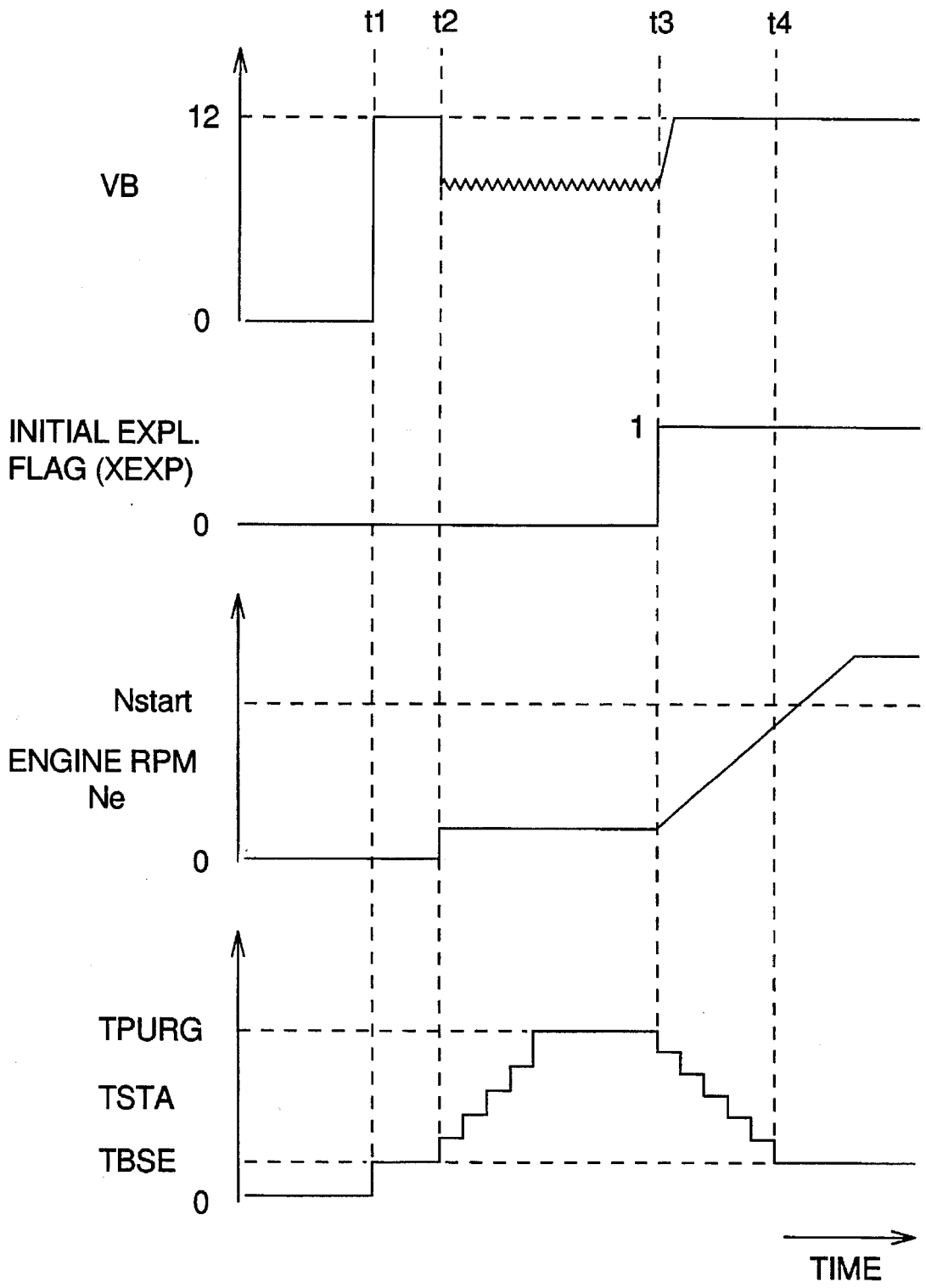
FIG. 17 is a time chart for explaining the flow charts in FIGS. 15 and 16.

The above-described control process of ECU 12 may be modified as shown in FIGS. 15 through 17 in which like steps are designated by like reference numerals. In place of the initial routine of FIG. 7 and the start injection routine of FIG. 8, routines of FIG. 15 and 16 may be performed. According to this modification, as shown in a time chart of FIG. 17, from the timing t1 when the key switch 20 is switched to the "ON" position to the timing t2 when the key switch 20 to the "START" position for cranking the engine E, fuel injection is performed by the basic pulse TBSE. After the timing t2, fuel injection amount or period is gradually increased toward the high temperature pulse TPURG by incrementing a predetermined amount at every time interval or every injection timing so that spark plugs may be assuredly prevented from being wetted by fuel.

The process of FIG. 15 differs from that of FIG. 7 in that the basic pulse TBSE is used as the starting pulse TSTA and the high temperature pulse TPURG at a step 121, and that, at a step 131 the basic pulse TBSE is used as the starting pulse TSTA and the high temperature pulse TPURG is obtained by the addition of the pulse TPURG1and TPURG2calculated in accordance with the water temperature TW and the intake air temperature TA.

The process of FIG. 16 differs from that of FIG. 8 in that, between the step 200 (NO) and the step 210, newly added are a step 270 which obtains the starting pulse TSTA by adding a predetermined value B to the basic pulse TBSE, a step 280 which compares the starting pulse TSTA with the high temperature pulse TPURG, and a step 290 which uses the high temperature pulse TPURG as the starting pulse when the starting pulse TSTA becomes larger than the high temperature pulse TPURG. Thus, fuel injection characteristic shown between the timings t2 and t3 in FIG. 17 is performed.

Figure 18:
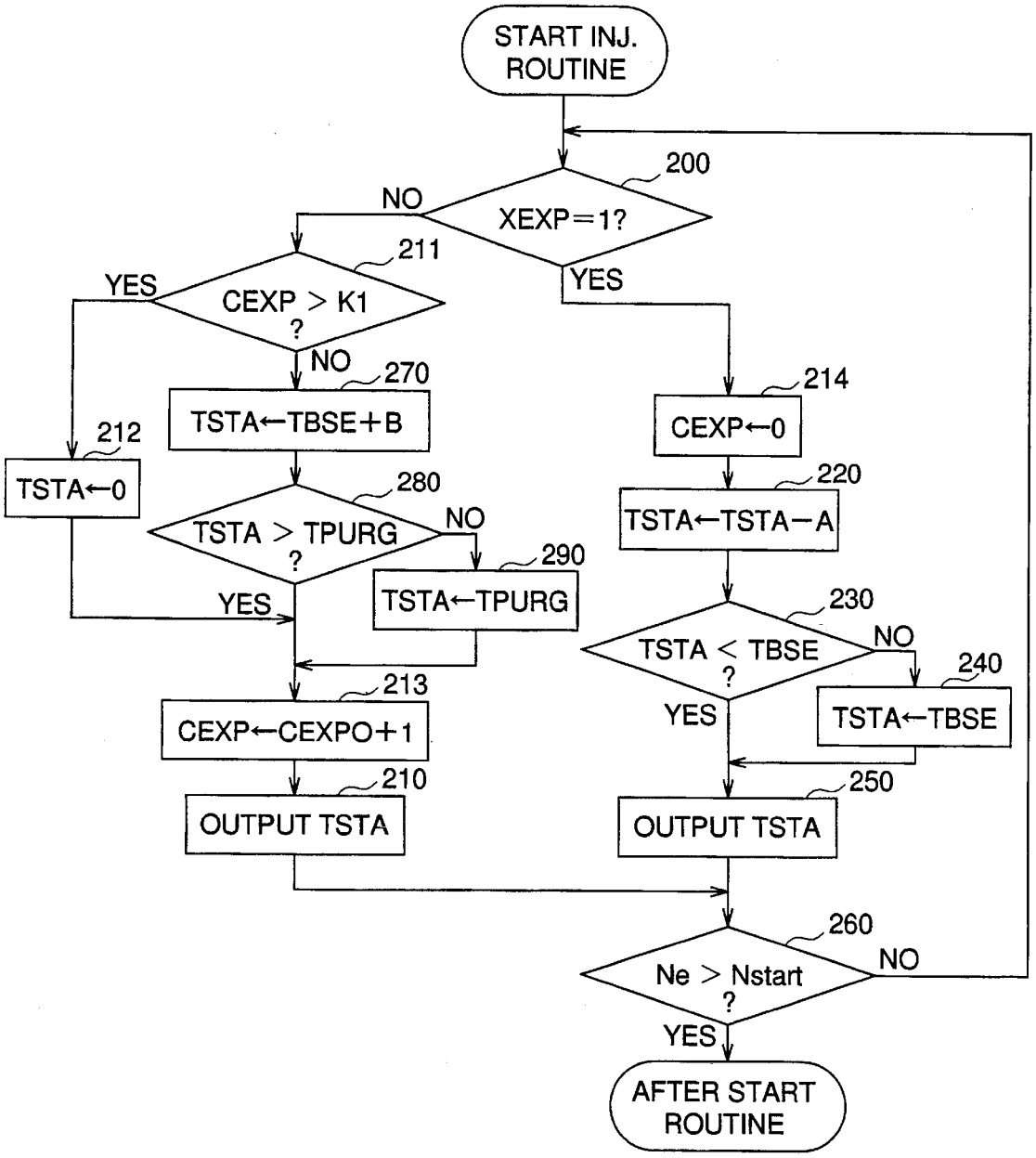
FIG. 18 is a flow chart showing a further modification of the start injection routine of FIG. 16.

The control process of ECU 12 may be further modified such that the start injection routine of FIG. 16 is replaced by a routine shown in FIG. 18. In FIG. 18, relative to FIG. 16, a step 211 which judges whether a counter value CEXP which measures time lapse from initiation of cranking is larger than a predetermined value K1 (for example, 15 seconds) is added subsequent to the step 200 (NO) so that the step 270 is performed to gradually increase the fuel injection amount when the counter value CEXP is not larger than the predetermined value K1 and the step 212 is performed when the counter value CEXP is larger than the predetermined value K1 to thereby setting the starting pulse TSTA to zero for cutting off the fuel injection. Further, a step 213 is added to increment the counter value CEXP before moving to the step 210, and a step 214 is added between the steps 200 (YES) and 220 to reset the counter value CEXP to zero. According to this modification, the fuel injection is forcibly stopped to prevent wetting of spark plugs and harmful unburnt exhaust gas when the initial explosion in the engine is not detected even after a lapse of a predetermined time measured from the initiation of cranking operation of the engine.

Figure 19:
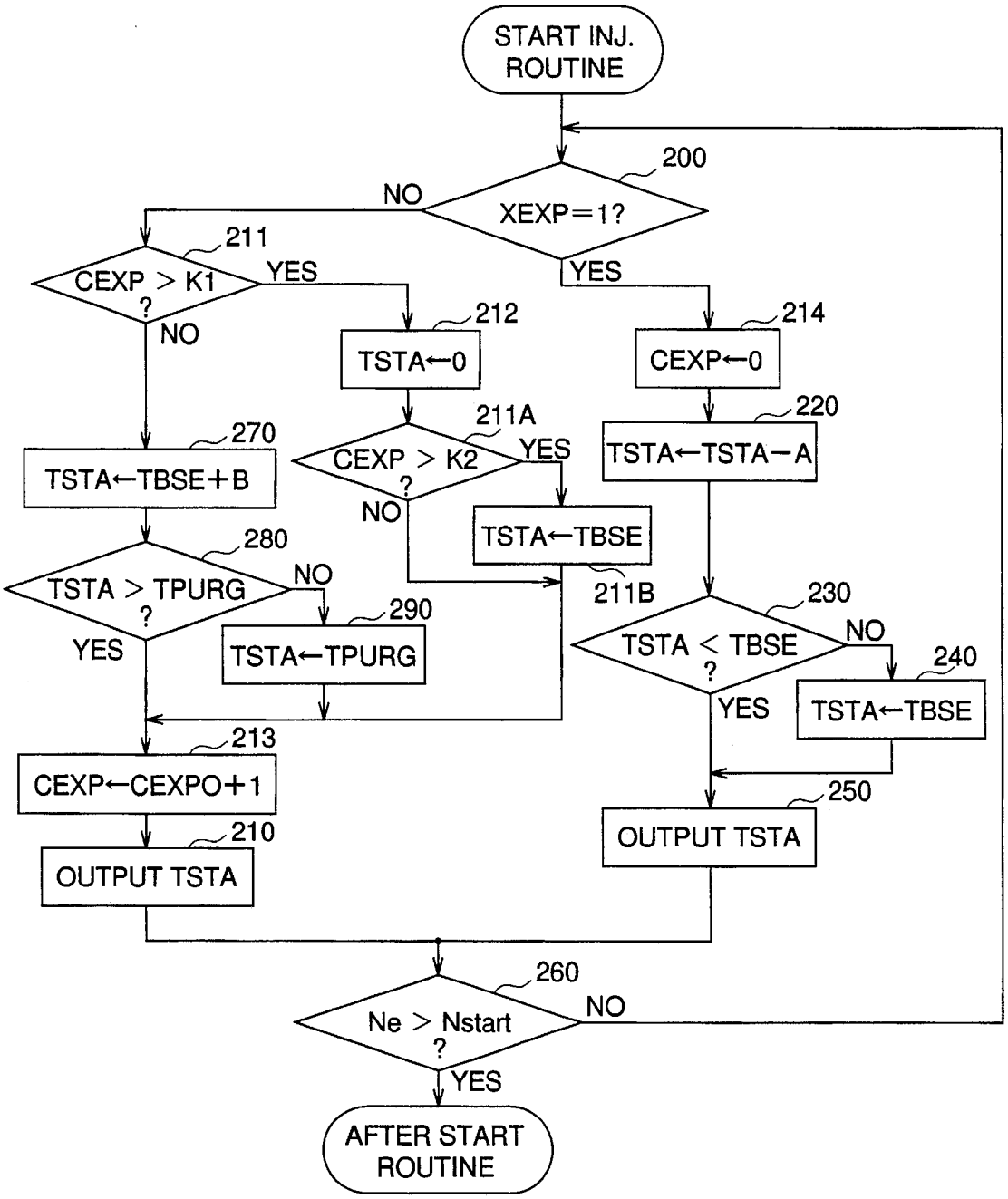
FIG. 19 is a flow chart showing a still further modification of the start injection routine of FIG. 18.

The control process of ECU 12 may be modified still further as shown in FIG. 19. In FIG. 19, relative to the start injection routine of FIG. 18, a step 211A is added subsequent to the step 212 to judge whether the counter value CEXP is larger than a predetermined value K2 (K2>K1, for example 30 seconds) so that the step 213 is performed when the counter value CEXP is not larger than the predetermined value K2 and a step 211B is performed when the counter value CEXP is larger than the value K2 to set the basic pulse TBSE to the starting pulse TSTA for re-starting fuel injection. According to this further modification, fuel injection by the basic pulse TBSE is re-started to enable operation of the engine E when the wetting of the spark plugs is removed by the continued cracking of the engine for more than the predetermined period after the stopping or cutting-off of the fuel injection.

What is claimed is:

1. A fuel supply system for supplying fuel from a fuel tank to an engine through fuel injectors comprising:

means for increasing an amount of fuel injected from said injectors when said engine is re-started so that vapor in the fuel is purged through said injectors;

means for detecting an initial explosion in said engine from a time variation in a parameter dependent on engine operation, said time variation being calculated by determining a difference between a current value of said parameter and a previous value of said parameter;

means for terminating increasing the amount of fuel by said increasing means when said initial explosion is detected by said detecting means; and means for cutting off fuel injection from said injectors when no initial explosion in said engine is detected by said detecting means for a predetermined period from the initiation of cranking said engine.

2. A fuel supply system according to claim 1, wherein said detecting means comprises:

means for calculating said time variation in a battery voltage; and means for comparing said calculated variation in said battery voltage with a predetermined value.

3. A fuel supply system according to claim 1, wherein said detecting means comprises:

means for calculating said time variation in a rotational speed of said engine; and means for comparing said calculated variation in said rotational speed with a predetermined value.

4. A fuel supply system according to claim 1, wherein said increasing means includes:

means for starting increasing said amount of fuel in response to initiation of cranking said engine and gradually increasing said amount of fuel until said initial explosion in said engine is detected.

5. A fuel supply system according to claim 1 further comprising:

means for re-starting fuel injection from said injectors when said engine is continued to be cranked for a predetermined period from said cutting-off of fuel injection.

6. A fuel supply system according to claim 1 further comprising:

a fuel piping for supplying fuel from said fuel tank;

a delivery pipe connected to said fuel piping and having a closed end at a most downstream portion of fuel flow for storing therein the fuel supplied from said fuel piping; and a plurality of connectors provided in said delivery pipe for supplying therethrough the stored fuel to said injectors, respectively, at least one of said connectors being extended upwardly to open at an upper portion in said delivery pipe so that air and vapor in said delivery pipe is injected into said engine with the fuel.

7. A fuel supply system for supplying fuel from a fuel tank to an engine through fuel injectors comprising:

means for increasing an amount of fuel injected from said injectors when said engine is re-started so that vapor in the fuel is purged through said injectors;

means for detecting an initial explosion in said engine from a time variation in a battery voltage, said means for detecting having:

means for calculating said time variation in said battery voltage; and means for comparing said calculated variation in said battery voltage with a predetermined value;

means for terminating increasing the amount of fuel by said increasing means when said initial explosion is detected by said detecting means and means for cutting off fuel injection from said injectors when no initial explosion in said engine is detected by said detecting means for a predetermined period from the initiation of cranking said engine.

8. A fuel supply system according to claim 7, wherein said increasing means includes:

means for starting increasing said amount of fuel in response to initiation of cranking said engine and gradually increasing said amount of fuel until said initial explosion in said engine is detected.

9. A fuel supply system according to claim 7 further comprising:

means for re-starting fuel injection from said injectors when said engine is continued to be cranked for a predetermined period from said cutting-off of fuel injection.

10. A fuel supply system according to claim 7 further comprising:

a fuel piping for supplying fuel from said fuel tank;

a delivery pipe connected to said fuel piping and having a closed end at a most downstream portion of fuel flow for storing therein the fuel supplied from said fuel piping; and a plurality of connectors provided in said delivery pipe for supplying therethrough the stored fuel to said injectors, respectively, at least one of said connectors being extended upwardly to open at an upper portion in said delivery pipe so that air and vapor in said delivery pipe is injected into said engine with the fuel.

11. A fuel supply system for supplying fuel from a fuel tank to an engine through fuel injectors comprising:

means for increasing an amount of fuel injected from said injectors when said engine is re-started so that vapor in the fuel is purged through said injectors;

means for detecting an initial explosion in said engine from a time variation in a rotational speed of said engine, said means for detecting having:

means for calculating said time variation in said rotational speed of said engine; and means for comparing said calculated variation in said rotational speed with a predetermined value;

means for terminating increasing the amount of fuel by said increasing means when said initial explosion is detected by said detecting means and means for cutting off fuel inception from said injectors when no initial explosion in said engine is detected by said detecting means for a predetermined period from the initiation of cranking said engine.

12. A fuel supply system according to claim 11, wherein said increasing means includes:

means for starting increasing said amount of fuel in response to initiation of cranking said engine and gradually increasing said amount of fuel until said initial explosion in said engine is detected.

13. A fuel supply system according to claim 11 further comprising:

means for re-starting fuel injection from said injectors when said engine is continued to be cranked for a predetermined period from said cutting-off of fuel injection.

14. A fuel supply system according to claim 11 further comprising:

a fuel piping for supplying fuel from said fuel tank;

a delivery pipe connected to said fuel piping and having a closed end at a most downstream portion of fuel flow for storing therein the fuel supplied from said fuel piping; and a plurality of connectors provided in said delivery pipe for supplying therethrough the stored fuel to said injectors, respectively, at least one of said connectors being extended upwardly to open at an upper portion in said delivery pipe so that air and vapor in said delivery pipe is injected into said engine with the fuel.

15. A fuel supply system for supplying fuel from a fuel tank to an engine through fuel injectors comprising:

(A) means for increasing an amount of fuel injected from said injectors when said engine is re-started so that vapor in the fuel is purged through said injectors;

(B) means for detecting an initial explosion in said engine from a time variation in a parameter dependent on engine operation, said detecting means comprising:

(i) means for calculating said time variation in said parameter; and (ii) means for comparing said calculated variation in said parameter with a predetermined value;

(C) means for terminating increasing the amount of fuel by said increasing means when said initial explosion is detected by said detecting means; and (D) means for cutting off fuel injection from said injectors when no initial explosion in said engine is detected by said detecting means for a predetermined period from the initiation of cranking said engine.

* * * * *